US009856609B2

(12) United States Patent
Dehmel

(10) Patent No.: US 9,856,609 B2
(45) Date of Patent: Jan. 2, 2018

(54) RAIL-BOUND TRANSPORTATION SYSTEM FOR A TRACK BUILDING MACHINE

(71) Applicant: K & K Maschinenentwicklungs GmbH & Co. KG, München (DE)

(72) Inventor: Wolfram Peter Dehmel, Passau (DE)

(73) Assignee: K & K MASCHINENENTWICKLUNGS GHBM & CO. KG, Munich (DE)

( * ) Notice: Subject to any disclaimer, the term of this patent is extended or adjusted under 35 U.S.C. 154(b) by 164 days.

(21) Appl. No.: 14/442,991

(22) PCT Filed: Nov. 14, 2013

(86) PCT No.: PCT/EP2013/073780
§ 371 (c)(1),
(2) Date: May 14, 2015

(87) PCT Pub. No.: WO2014/076160
PCT Pub. Date: May 22, 2014

(65) Prior Publication Data

US 2015/0345084 A1 Dec. 3, 2015

(30) Foreign Application Priority Data

Nov. 15, 2012 (DE) ..... 10 2012 220 916

(51) Int. Cl.
*E01B 27/00* (2006.01)
*E01B 27/08* (2006.01)
(Continued)

(52) U.S. Cl.
CPC ..... *E01B 27/08* (2013.01); *E01B 27/00* (2013.01); *E01B 27/11* (2013.01); *E01B 1/001* (2013.01)

(58) Field of Classification Search
CPC ..... E01B 27/00; E01B 27/08; E01B 27/11; E01B 29/05; E01B 1/001; E01B 29/02; E01B 27/04; E01B 29/16; E01B 37/00
See application file for complete search history.

(56) References Cited

U.S. PATENT DOCUMENTS 3,443,674 A * 5/1969 Kornylak ..... B65G 13/11 193/37
5,174,211 A * 12/1992 Snead ..... E01B 29/02 104/3
(Continued)

FOREIGN PATENT DOCUMENTS

CN 201195817 * 2/2009
CN 202466344 * 10/2012
(Continued)

OTHER PUBLICATIONS

CN 202466344 (Oct. 2012)—English Translation.*
(Continued)

*Primary Examiner* — Mark T Le

(57) ABSTRACT

In a method for restoring, renovating or rebuilding a railway, a substructure or part of a substructure is installed, a track bed is installed and a track grid is installed and/or an existing track grid is extended, an existing track bed is extended and an existing substructure or part of a substructure is extended. There is provision that the installation of the track grid, the installation of the track bed and the installation of the substructure or part of the substructure takes place in a single working process and/or in that the extension of the existing track grid, the extension of the existing track bed and/or the extension of the existing substructure or part of the substructure takes place in a single working process. Track bed material and/or substructure material is transported to the site and/or away from the site by rail.

20 Claims, 3 Drawing Sheets

(51) Int. Cl.
*E01B 27/11* (2006.01)
*E01B 1/00* (2006.01)

(56) References Cited

U.S. PATENT DOCUMENTS

| | | | | |
|---|---|---|---|---|
| 7,470,094 | B2 * | 12/2008 | Heathcott | B29D 28/00 405/129.85 |
| 2009/0274516 | A1 * | 11/2009 | Colkitt | E01C 23/04 404/75 |

FOREIGN PATENT DOCUMENTS

| | | | |
|---|---|---|---|
| DE | 4339833 | * | 5/1995 |
| DE | 4339833 | A1 | 5/1995 |
| DE | 19916585 | A1 | 10/2006 |
| EP | 1127980 | * | 8/2001 |
| EP | 1127980 | A2 | 8/2001 |
| EP | 1775190 | A2 | 4/2007 |
| EP | 2487294 | A1 | 8/2012 |

OTHER PUBLICATIONS

CN 201195817 (Feb. 2009)—English Translation.*
EP1127980 (Aug. 2001)—English Translation.*
DE 4339833 (May 1995)—English Translation.*

* cited by examiner

RAIL-BOUND TRANSPORTATION SYSTEM FOR A TRACK BUILDING MACHINE

FIELD OF THE INVENTION

The present invention relates to a method for the new production, renovation or dismantling of a rail track which comprises a subgrade, a road bed and a track panel laid thereon and having rails and sleepers, wherein the method comprises the following steps:

installing a subgrade or a part of a subgrade;

installing a road bed; and installing a track panel;

and/or wherein the method comprises the steps:

removing an existing track panel:

removing an existing road bed; and removing an existing subgrade or part of a subgrade, wherein the installation of the track panel, the installation of the road bed and the installation of the subgrade or part of the subgrade take place in a single operation and/or the removal of the existing track panel, the removal of the existing road bed and the removal of the existing subgrade or part of the subgrade take place in a single operation.

BRIEF SUMMARY OF THE INVENTION

So-called fast reconstruction processes are known in track construction in which the sleepers and rails of a track panel to be renewed are replaced. The ballast of the road bed is shifted in this respect, but is not cleaned or replaced. A desired ballast cleaning can take place in a separate operation using a special machine which takes up the used ballast of the road bed, treats it and subsequently directly reinstalls it.

It is frequently necessary not only to renew the road bed, but also the associated subgrade, the so-called formation. In this respect, typically at least one further layer has to be installed as new or replaced in addition to the ballast layer; for example, a protective layer, a support layer or an arrangement of a plurality of sequential protective layers or support layers. A substrate which is not capable of load bearing is often removed in this process and is replaced by a support layer structure more capable of load bearing. The support stability of the rail track can hereby be increased.

Since the track panel and the road bed are installed and/or removed in a single operation, the number and the duration of track closures can be reduced. A substantially higher performance can be achieved with respect to a total new track construction or rail reconstruction than with a temporal or spatial separation of the work relating to the track panel and to the track bed.

It must be pointed out that the term "operation" is not to be understood in the sense of "workstep" in connection with the present invention.

Specifically, the work relating to the track panel and to the track bed typically comprise a plurality of individual worksteps. A carrying out of work in a single operation is to be understood in contrast as the completion of all required worksteps at a specific location and in a direct time sequence.

It is a problem with existing track reconstruction systems that only existing material, optionally treated material, can be used for the ballast bed and for the subgrade layers. If this already shows severe wear, it is possible that the renovated rail track does not have the desired stability. It is furthermore difficult to coordinate the different operations "track panel renewal", "ballast bed cleaning" and formation improvement", including the corresponding machine deployment. In addition, the performance of existing renovation machines is only small. This in particular applies to discontinuously working machines which e.g. replace a track panel section by section, that is piece by piece.

It is an object of the invention to make possible a faster, more flexible and more effective new production, renovation or dismantling of rail tracks.

The object is satisfied by a method for the new production, renovation or dismantling of a rail track having the features of the present disclosure.

Provision is made in accordance with the invention that, in the operation of installing the subgrade or a part of the subgrade, the track panel and the track bed, both material for the road bed to be installed, such as new ballast, and material for the subgrade or part of the subgrade to be installed, such as new sand or new gravel, is transported inward in a rail-bound manner; and/or that, in the operation of removing the existing track panel, the existing road bed and the existing subgrade or part of the subgrade, both material of the removed road bed, such as old ballast, and material of the removed subgrade or part of the subgrade, such as old sand or old soil, is transported away in a rail-bound manner. The restriction to used material present on site is thereby dispensed with. The supply with new material is also possible in regions of a rail track whose surroundings are not accessible or which are only accessible with difficulty thanks to the rail-bound inward transport.

Further developments of the invention are set forth in the description and in the enclosed drawings.

Provision is preferably made that the rail-bound inward transport of material for the road bed to be installed, of material for the track panel to be installed, and of material for the subgrade or part of the subgrade to be installed takes place simultaneously, and/or that the rail-bound transporting away of material of the removed track panel, of material of the removed road bed and of material of the removed subgrade or part of the subgrade takes place simultaneously. The construction time can hereby be substantially shortened.

Provision can furthermore be made that the rail-bound transporting inward of material for the road bed to be installed and of material for the subgrade or part of the subgrade to be installed takes place without intermediate storage and/or that the rail-bound transporting away of material of the removed road bed and of material of the removed subgrade or part of the subgrade takes place without intermediate storage.

The rail-bound transporting inward and/or transporting away of material can be carried out on at least one conveyor track of a railroad vehicle on which transport bodies for articles or for articles forming transport bodies in the form of piece goods can be traveled along the railroad vehicle.

In accordance with an embodiment of the invention, in the operation of installing the subgrade or part of the subgrade, the track panel and the road bed, at least one protective layer is installed for the subgrade, in particular a protective formation layer a frost protection layer and/or a water protection layer. Such additional subgrade layers can e.g. comprise sand, gravel, specific grain mixtures such as KG1 and KG2, and/or asphalt. The corresponding materials are preferably likewise transported inward in a new state in a rail-bound manner, for example in transport containers on a conveyor track of the machine carrying out the reconstruction. The stability of the rail track can be considerably improved by the introduction of additional layers into the subgrade, in particular when new material is used.

A plurality of protective layers for the subgrade can also be installed, with a separation layer being installed at least between two of the plurality of protective layers, said separation layer in particular comprising a geotextile material and/or a hard foam material. Such separation layers can counter an unwanted mixing of the materials of adjacent protective layers. It can additionally thus be prevented that the ground lying beneath the support layers mixes with the bottommost support layer and thereby contaminates it and impairs its load-bearing capability.

The surface of the installed protective layer or of the plurality of installed protective layers can furthermore be sealed, in particular by applying cement. A penetration of water into the protective layer can hereby be prevented.

In accordance with a further embodiment of the invention, the installed protective layer or the plurality of installed protective layers are at least simply reinforced, in particular using a geogrid, a metal mat or an expanded metal sheet. The subgrade can hereby be reinforced.

In accordance with an embodiment, of the invention, the installed protective layer or the plurality of installed protective layers are reinforced using a metal mat which is produced from wires during the new production or renovation of the rail track. The wires can in this respect be taken along on the respective machine or can be supplied in a rail-bound manner so that the reinforcement can take place continuously without time delay. A specific embodiment of the invention provides that individual taken-along wires or wires supplied in a rail-bound manner are welded to form a grid prior to the installation in the respective machine.

Alternatively or additionally, the installed protective layer or the plurality of installed protective layers are reinforced using an expanded metal sheet which is produced by drawing out a coil during the new production or the renovation of the rail track.

At least one protective layer to be installed is preferably installed in a plurality of part layers, with each part layer preferably being compacted prior to the application of a subsequent part layer. The compacting can take place using a profiled compacting element to effect a strong interleaving of the layers among one another. The step-wise introduction of a protective layer in a plurality of comparatively thin layers simplifies the compacting process.

At least one installed protective layer or part layer of a protective layer can furthermore be roughened prior to the application of a subsequent protective layer or part layer of the same protective layer. The interleaving effect between individual layers or part layers can hereby be improved and the total stability of the subgrade can thus be increased. A profile can in particular be produced on a compacting of a layer which promotes an interleaving effect.

In accordance with a further embodiment of the invention, the number and the thickness of the installed protective layers is varied in dependence on the property of the ground during the installation of the subgrade or part of the subgrade. The installed layers can thus be dynamically adapted to the varying ground conditions.

Provision can be made that the installation of the subgrade or part of the subgrade, of the track panel and of the road bed is carried out by means of a railroad work vehicle, wherein a web of a geomaterial, in particular of a geoplastic, of a geotextile or of a geocomposite which is taken along on the railroad work vehicle is installed in the subgrade or part of the subgrade. The construction time can be considerably shortened by the taking along of the webs on the track construction machine itself with respect to the procedure typical in the technical field of delivering webs of geomaterial separately and of providing them along the rail track prior to the start of construction. It is a particular advantage that track closures for those track vehicles delivering the webs can be avoided. Furthermore, in the conventional procedure, the provided webs have to be introduced by hand into a laying apparatus of the track construction machine, which can only take place with a stationary machine and which is laborious for the construction personnel. These disadvantages can be avoided by the taking along of the geomaterial webs on the track construction machine.

The at least one web of geomaterial can in particular be taken along in a rolled up and/or folded state on the railroad work vehicle and can be removed automatically for the installation. The web can, for example, be folded once completely in the longitudinal direction and subsequently can be either rolled or folded in the transverse direction. Before the installation, the web can then be automatically unrolled or unfolded again by means of a suitable apparatus. As soon as the web has been completely laid, a further web taken along on the railroad work vehicle is preferably automatically provided. The mounting of this further web is preferably carried out automatically.

Furthermore, the at least one web of geomaterial can be taken along on the railroad work vehicle as a roll wound around a coil axle, wherein the coil axle extends in parallel with the direction of work of the railroad work vehicle and the web is automatically unrolled and rotated, preferably b 90°, before laying. This takes the circumstance into account that conventional geomaterial webs are significantly wider than the railroad work vehicle provided for the transport. The roll itself can in principle be of any width due to the storage of the corresponding roll transversely to the direction of rolling off.

In accordance with a particular embodiment of the invention, a plurality of webs of geomaterial are laid next to one another by means of an automatic laying apparatus of the railroad work vehicle. It is thereby sufficient to take along relatively narrow rolls on the railroad work vehicle, which is of considerable advantage with respect to storage and handling capability. Such narrow rolls can in particular be transported and rolled off as required both in the direction of travel and transversely to the direction of travel.

Furthermore, the road bed of an adjacent rail track can be supported, in particular by a shoring system running along, during the removing of the existing subgrade or part of the subgrade. This is in particular of advantage when the total thickness of the layers of the subgrade to be removed and installed exceeds a predefined limit.

In accordance with a further embodiment of the invention, a material is used for the installation of the subgrade or part of the subgrade which was removed in the operation of removing the existing subgrade or part of the subgrade. The quantity of new material to be conveyed can hereby be reduced or the supply of new material can be completely dispensed with. If required, the ground can also be treated after the removing of the existing subgrade or part of the subgrade and prior to the installation of the subgrade or part of the subgrade by applying a preferably pourable stabilization means, in particular lime or cement, wherein in particular the stabilizing means is transported inward in a rail-bound manner. The load capability of the rail track can hereby be further increased.

It is preferred that the rails for the track panel to be installed are transported inward in a rail-bound manner and/or that the rails of the removed track panel are transported away in a rail-bound manner, in particular in each case without an intermediate storage of the rails on the ground. This increases the efficiency of the total process.

The rails of the removed track panel can in this respect be cut prior to the transporting away to ensure a better handling capability.

Provision is made in accordance with a further embodiment of the invention that the rails for the track panel to be installed are transported inward in a rail-bound manner together with material for the road bed to be installed and/or for the subgrade or part of the subgrade to be installed, such as new ballast or new sand, and/or that the rails of the removed track panel are transported away in a rail-bound manner together with material of the removed road bed and/or of the removed subgrade or part of the subgrade, such as old ballast or old sand. The routine of the total track preparation, track removal or track renovation can thereby be further accelerated. The transport can take place on one or more conveyor tracks of the railroad work vehicle carrying out the track reconstruction, wherein in an advantageous manner bulk material is conveyed in transport containers separately provided for this purpose and piece goods such as rails, sleepers and track panel pieces are conveyed on one and the same conveyor track.

The transporting inward and/or away of the rails preferably takes place without infringing the clearance of a train traveling in an adjacent rail track. The opposite track of the rail track to be prepared, to be renovated or to be removed thus does not have to be closed for carrying out the construction measures.

In accordance with a further embodiment of the invention, the ground is compacted after the removal of the existing subgrade or part of the subgrade and prior to the installation of the subgrade or part of the subgrade to provide a more stable foundation for the rail track to be prepared.

Furthermore, in accordance with an embodiment of the invention, the moisture of the ground to be compacted is measured and water is introduced as required into provided material for the subgrade or part of the subgrade to be installed prior to the compacting in dependence on the measured moisture. The moisture of the ground can thus be exactly adapted to the demands of the compacting process. The moisture of material to be installed can equally be measured and adapted as required.

It can be preferred with specific applications that a measured variable, in particular the acceleration, of a compactor element is detected on the compacting and at least one compacting parameter is adapted in dependence on the detected measured variable. A permanent compacting monitoring is possible in this manner. If required, the compacting process can be controlled using a corresponding control device. The detected data can furthermore be stored continuously for a later use.

In accordance with a further embodiment of the invention, new ballast, used ballast or recycled ballast is used on the installation of the road bed in dependence on a local load situation. E.g. new ballast can be used directly at positions important with respect to the load capability, for instance in the region of the carrier head beneath the track or ahead of the end, whereas at positions of less importance with respect to load capability, for instance in the region of the sleeper center or, with two-track rail tracks, in the region between the two track directions, used ballast is used. The requirement of new ballast can thus be kept low and a high stability of the road bed can nevertheless be achieved.

As required, the installed ballast can be compacted, in particular prior to the installation of the track panel, in the operation of installing the road bed. As required, the installed ballast can be tamped and/or dynamically stabilized after the installation of the road bed. The tamping or the dynamic stabilization can also be repeated several times if this is required. Separate compacting, tamping and stabilization processes can thereby be saved. A tamping round can optionally be saved by a sufficient compacting of the base ballast.

The installed road bed can also be profiled, with such a profiling likewise being able to take place multiple times after one another as required.

In accordance with a further embodiment of the invention, the position of the installed track panel is detected and documented in the operation of installing the track panel.

Furthermore, in the operation of installing the track panel, the ironware of the installed track panel can be closed, in particular screwed together.

A railroad work vehicle can in particular be used for the carrying out of a process as described above. A single railroad work vehicle is preferably used for all process steps.

The rails for the track panel to be installed and/or the rails of the removed track panel can be conveyed in accordance with an embodiment of the invention through a railroad vehicle, preferably on a rail conveyor track arranged in or at the railroad vehicle and particularly preferably between the wheel disks. This facilitates a track installation and/or track removal at positions which are difficult to access. The closure period for the transporting inward and away of the long-welded rails can furthermore be saved. Since the rail conveying takes place in the clearance between the wheel disks, which is typically only usable with difficulty, the remaining clearance of the railroad vehicle, which is easily usable, is free for a conveying of further material, e.g. of bulk material in corresponding transport containers.

In accordance with an embodiment of the invention, the rails are conveyed on at least one rail conveyor track which is provided at a side of the railroad vehicle, with the rails preferably being conveyed on a plurality of rail conveyor tracks arranged above one another or next to one another. A plurality of rail conveyor tracks can also be provided arranged above one another or next to one another at each side of the railroad vehicle. It is thus e.g. possible to transport inward two rails required for a track panel at aside of the railroad vehicle, while two rails of a removed track panel are transported away at the other side of the railroad vehicle. Material such as new ballast or new sleepers can then be transported inward simultaneously in the central region of the clearance of the railroad vehicle and used material such as old ballast or old sleepers can optionally be transported away.

It may be favorable in specific track construction work that the rails of the removed track panel are taken up from the ground, in particular at the side of the railroad vehicle, and are transferred to a rail conveyor tack arranged in or at the railroad vehicle, and preferably between the wheel disks, for the transporting away and/or that the rails for the track panel to be installed are transported inward on a rail conveyor track arranged in or at the railroad vehicle, and preferably between the wheel disks, and are transferred for the putting down into a region to the side of the railroad vehicle or beneath the railroad vehicle. The conveyed rails can in this respect be taken up or put down both between the rails of the existing track and next to the rails of the existing track. An arrangement of the rail conveyor track above the wheel shafts is preferred.

A further embodiment of the invention provides that the rails are drawn by means of a tensile force transfer device, in particular a rope, band or chain, onto a rail conveyor track of the railroad vehicle or down therefrom, with in particular a drawing in of tensile force transfer devices into the rail conveyor track taking place by means of rails drawn down from the rail conveyor track. This allows a particularly simple transfer of the rails onto the rail conveyor track. Provision can be made that a rope, a band or a chain is already drawn into the rail conveyor track before the rail to be drawn in. Furthermore, a mounting aid, for example in the form of a component in arrow tip shape, can be attached to a front end of the rail to facilitate the mounting of the rail into the rail conveyor track. A rope can equally be fastened to the end of a rail. If this rail is drawn out of the rail conveyor track, the rope is drawn into the rail conveyor track.

It may furthermore be favorable in specific applications to cut the rails to length for the rail-bound transporting inward and/or for the rail-bound transporting away and to move them into a transport container.

The conveying of the rails, in particular including the mounting into and/or out of the railroad vehicle and/or into and/or out of the rail store, preferably takes place automatically. The total process can thereby be further accelerated.

If required, the rails for the track panel to be installed and/or the rails of the removed track panel can be temporarily placed on the ground, in particular on storage rollers arranged at the ground. Such storage rollers considerably reduce the required tensile force for the transport of the rails. The storage rollers can be positioned on the ground in front of the machine carrying out the track production, the track renovation or the track dismantling and are optionally taken up again after the taking back up of the rails which have been put down.

The invention also relates to a railroad work vehicle which is configured for carrying out a method as described above.

The railroad work vehicle preferably comprises a construction module for installing the track panel and for installing material of the road bed and preferably for installing material of the subgrade or part of the subgrade and/or a construction module for removing the track panel and for removing material of the existing road bed and preferably for removing material of the existing subgrade or part of the subgrade. If required, the railroad work vehicle can additionally comprise at least one recycling module separate from the construction module or construction modules for cleaning removed material. A track reconstruction can thus be combined with a ballast cleaning and the closure time can thus in particular be restricted to a minimum.

The railroad work vehicle furthermore preferably comprises an apparatus for releasing and/or for fastening ironware. This facilitates the continuous installation of the track panel and the removal of the existing track panel.

The railroad work vehicle can also comprise, in accordance with an embodiment of the invention, an apparatus for taking up and transporting the rails of the removed track panel. The railroad work vehicle can furthermore comprise a compacting apparatus such as a driven plate compactor or a vibration roller. Alternatively or additionally, the railroad work vehicle can comprise a tamping apparatus and/or profiling apparatus. The railroad work vehicle can also comprise at least one conveyor track on which transport bodies for articles or for articles forming transport bodies in the form of piece goods can be traveled along the railroad work vehicle.

The invention also relates to a system for a rail-bound transport of articles, for example for the transporting inward and away of material to or from a railroad work vehicle, having a plurality of railroad vehicles which can be coupled to one another and which each have at least one conveyor track on which the articles can be traveled along the railroad vehicles and which is configured such that the conveyor tracks of railroad vehicles coupled together adjoin one another, wherein transport bodies for the articles are provided which are configured for a travelability along mutually adjoining conveyor tracks from railroad vehicle to railroad vehicle, or wherein the articles are piece goods and themselves form such transport bodies. In accordance with the invention, the railroad vehicles furthermore each have at least one rail conveyor track on which rails can be conveyed through the rail vehicles.

BRIEF DESCRIPTION OF THE DRAWINGS

An embodiment of the invention is represented in the drawings and will be described in the following.

DETAILED DESCRIPTION OF THE INVENTION

Figure 1:
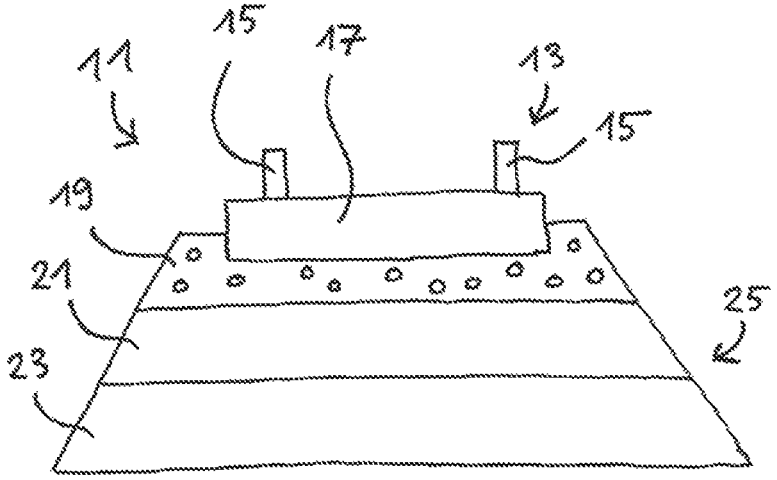
FIG. 1 is a sectional view of a rail track.

With the rail track 11 shown in FIG. 1, the track panel 13 is laid with rails 15 and sleepers 17 in a road bed 19 of ballast. The road bed 19 is applied to a protective layer 21 and the latter is in turn applied to the substrate 23. The protective layer 21 can e.g. be a protective formation layer composed of a grain mixture. The protective layer 21 and the substrate 23 together form a subgrade 25 of the rail track 11 which can comprise further layers in dependence on the embodiment. Provided that the subgrade 25 comprises a plurality of layers, they can also be separated by geomaterial layers or the like.

The new production, renovation or dismantling of a rail track 11 designed in accordance with the present disclosure is carried out in accordance with the invention by a railroad work vehicle which will be described in more detail in the following with additional reference to FIG. 2.

Figure 2:
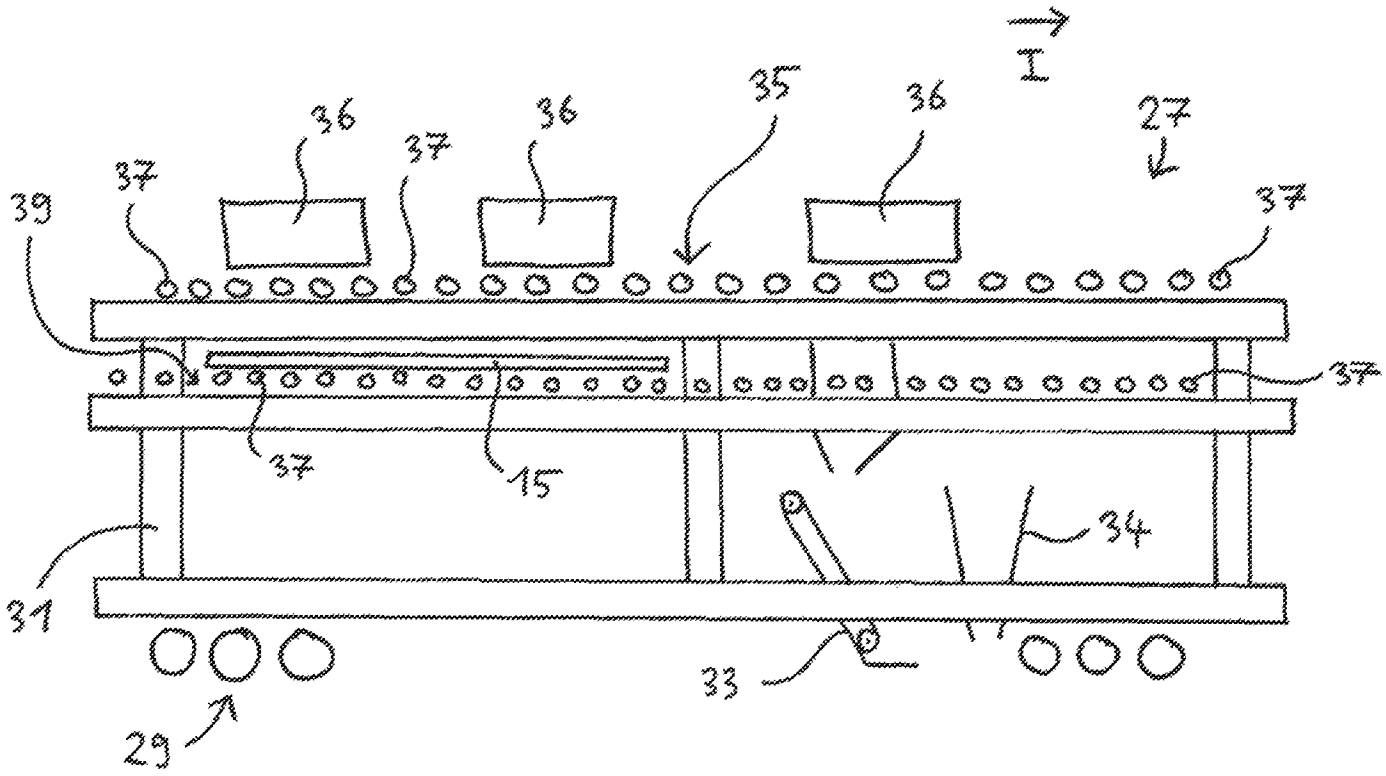
FIG. 2 is a simplified side view of a railroad work vehicle in accordance with the invention.

The railroad work vehicle 27 in accordance with the invention shown in FIG. 2 comprises a chassis 31 supported by an undercarriage 29 and a plurality of work devices which are supported by the chassis 31 and of which only one excavation apparatus 33 and one installation device 34 are shown by way of example.

The undercarriage 29 is a rail-mounted base in the embodiment shown. Instead of or in addition to a rail-mounted base, a traveling base, e.g. a crawler base, can also be provided. This allows the railroad work vehicle 27 also to operate without track, at least in its front part viewed in the direction of work, in the new production of a rail track.

A conveyor track 35 on which transport bodies 36 for goods can be traveled along the railroad work vehicle 27 is provided above the work devices 33, 34. The conveyor track 35 is here configured as a roller conveyor having rollers 37 on which the transport bodies 36 configured as boxes can be traveled. The rollers 37, or at least individual rollers 37, can be rotatably drivable for traveling the transport bodies 36. It must be pointed out that only a single conveyor track 35 is shown by way of example in FIG. 2. Further conveyor tracks can be provided in dependence on the purpose of use of the railroad work vehicle 27, with the plurality of conveyor tracks being arranged e.g. extending in parallel with one another next to one another and/or above one another.

The transport bodies 36 can receive all types of goods, in particular work material such as ballast, sand, gravel, cement, sleepers, ironware, platelets, asphalt, materials for ground improvement, collision stub posts and signal foundations, but also supply materials such as fuel and water.

They can serve both for the supply and for the disposal of the work devices 33, 34 of the railroad work vehicle 27.

The transport bodies 36 can, for example, be loaded with excavation material of the excavation device 33 over a conveyor belt, not shown.

To supply the installation device 34, a conveyor belt can likewise be provided which is not shown in FIG. 2 and which can be filled with material from the transport bodies 36 via a corresponding filling device. For this purpose, a device likewise not shown can be provided at a filling position for emptying the transport containers 36.

The existing track panel 13 can initially be removed by the railroad work vehicle 27 for renovating or dismantling an old rail track 11. For this purpose, the ironware is released automatically by a corresponding apparatus, preferably integrated into the railroad work vehicle 27.

The spreading apart of the used rails 15 subsequently takes place. For this purpose, the used rails 15 are separated from the sleepers 17 and are placed on a rail conveyor track 39 provided at the side at the chassis 31 of the railroad work vehicle 27. The rail conveyor track 39, like the conveyor track 35, has rollers 37 of which optionally at least some are rotatably drivable. If wanted, the put down, used rails 15 can therefore be transported away directly in or against the direction of work I.

Furthermore, the used sleepers 17 are taken up by a suitable apparatus integrated into the railroad work vehicle 27 and are brought into one or more of the transport bodies 36. The used sleepers 17 can easily be transported away on the conveyor track 35 in or against the direction of work I by means of the transport bodies 36. If the used sleepers cannot be transported due to their poor condition, they can also be put down next to the rail track 11 and can only be taken up manually after the end of the renovation process.

The removal of the road bed 19 and of the subgrade 25 subsequently takes place, preferably in a plurality of single layers. For example, for this purpose, the excavation apparatus 33 can be used, optionally in conjunction with further apparatus. The ballast of the removed road bed 19 and the material of the removed layers of the subgrade 25 are brought into one or more of the transport bodies 36 and are optionally transported away on the conveyor track 35 for disposal or are supplied to a recycling process.

Provided a dismantling of the rail track 11 is aimed for, the process ends here. Otherwise, the ground is watered as required and is treated by applying lime or cement and is compacted. Subsequently, a new subgrade 25 is installed—e.g. by means of the installation device 34. In this respect, at least one protective layer 21 is in turn installed, preferably in a plurality of thin layers. The material required for this purpose is transported inward in transport bodies 36 on the conveyor track 35.

After completion of the new subgrade 25, a new road bed 19 is installed and is compacted as required. The ballast for the road bed 19 is in turn transported inward in transport bodies 36 on the conveyor track 35.

As soon as the new road bed 19 has been completed, new sleepers 17 are placed down in the road bed 19. Subsequently, new rails 15 are transported inward on the rail conveyor track 39 and are automatically mounted into the rail store of the placed down sleepers 17. The preferably automatic transporting inward of the new rails 15 can in this respect take place on a further rail conveyor track, not visible in FIG. 2, at the other side of the railroad work vehicle 27. To allow a simultaneous conveying of four rails 15, e.g. of two used rails 15 of the removed track panel 13 and of two new rails 15 for the new rail panel 13 to be installed, two rail conveyor tracks 39 arranged above one another can be provided at each side of the railroad work vehicle 27. Optionally, further rail conveyor tracks 39 are provided on which a transport of long-welded rails through the railroad work vehicle 27 can take place. To allow a change from transported rails 15 from one rail conveying tack 39 to another rail conveyor track 39, corresponding switches can be provided.

In particular three pairs of rail conveyor tracks 39 can be provided, with one of the pairs serving for the conveying of a rail pair through the entire railroad work vehicle 27. It is hereby possible selectively to supply the rails 15 for the track panel 13 to be installed from the front or from the rear, with respect to the direction of work I, in dependence on the demand or selectively to transport the rails 15 of the removed track panel 13 to the front or to the rear.

In the further course of the renovation process, the ironware is screwed on and, if required, the renovated rail track 11 is tamped and/or dynamically stabilized once or a plurality of times.

In the case of a new production of a rail track 11, all work steps relating to the installation are carried out without previously carrying out the worksteps related to the removal.

As a result, the invention allows the renovation, new production or removal of a rail track 11, including an improvement of the subgrade 25, in a single continuous process by means of a single machine, optionally of modular design, or by means of a single machine complex.

The railroad work vehicle 27 shown in FIG. 2 can form a module of a railroad work train, with a plurality of such modules being able to be assembled in accordance with the invention. In this respect, each module can have different work devices; however, two or more modules which are the same can also be assembled. The conveyor tracks 35 and the rail conveyor tracks 39 of the modules are preferably configured such that the conveyor tracks of a plurality of modules form a continuous conveyor track. The conveyor tracks can also form a continuous conveyor track, for example with supply and/or disposal trains, with corresponding conveyor tracks of other track vehicles.

Figure 3:
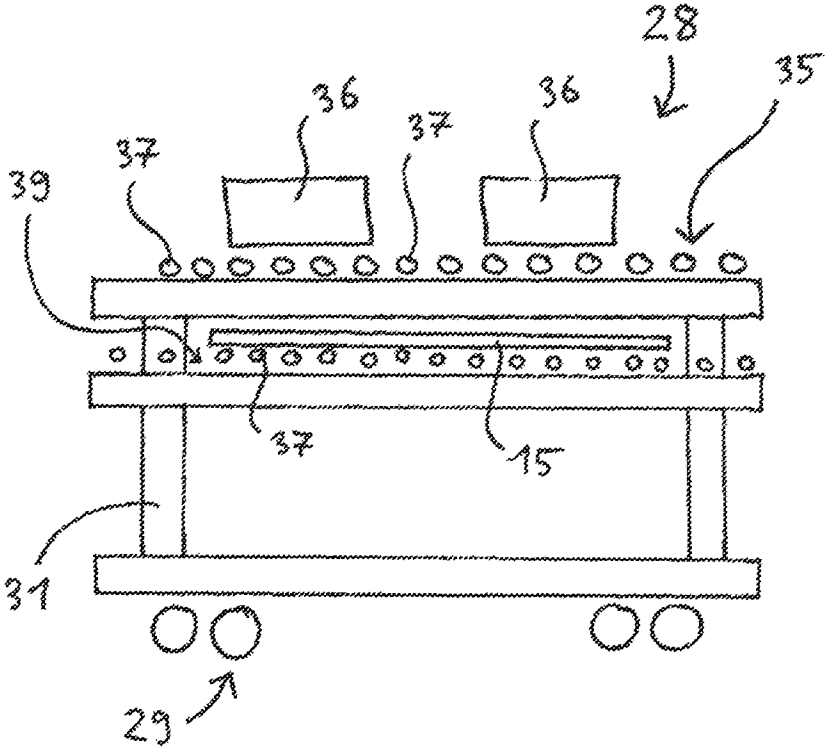
FIG. 3 is a simplified side view of a railroad vehicle in accordance with the invention which is configured for the rail-bound transporting inward and away to and from the railroad work vehicle in accordance with FIG. 2.

Specifically, the transporting inward and away of material to or from the railroad work vehicle 27 can take place by means of a train of a plurality of railroad work vehicles 28 which are coupled together and which will be described in more detail in the following with additional reference to FIG. 3.

The railroad work vehicle 28 is in principle of a similar design to the railroad work vehicle 27. It is, however, configured as a simple railroad car having a rail-mounted base 29 and has no work devices. As with the railroad work vehicle 27, a conveyor track 35 is provided on which the transport bodies 36 can be traveled. The conveyor track 35 is in turn configured as a roller track having rollers 37. Further conveyor tracks can also be provided, with the plurality of conveyor tracks e.g. being arranged extending in parallel with one another next to one another and/or above one another. A rail conveyor track 39 which, like the conveyor track 35, has rollers 37 is provided laterally at the chassis 31 of the railroad vehicle 28. The conveyor track 35 and the rail conveyor track 39 are configured such that the transport bodies 36 and the rails 15 can be traveled on thoroughgoing tracks from railroad vehicle 28 to railroad vehicle 28 and from a railroad vehicle 28 to the railroad work vehicle 27 when a train of railroad vehicles 28 is coupled from the left in FIG. 2 to the railroad work vehicle 27.

REFERENCE NUMERAL LIST

11 railroad track
13 track panel
15 rail
17 sleeper
19 road bed
21 protective layer
23 substrate
25 subgrade
27 railroad work vehicle
28 railroad vehicle
29 undercarriage
31 chassis
33 excavation apparatus
34 installation device
35 conveyor track
36 transport body
37 roller
39 rail conveyor track
I direction of work

The invention claimed is:

1. A method for a renovation of a rail track which comprises a subgrade, a road bed and a track panel laid thereon and having rails and sleepers, wherein the method comprises the following steps:

removing an existing track panel;
removing an existing road bed; and
removing an existing subgrade or part of a subgrade;
installing a subgrade or a part of a subgrade;
installing a road bed; and
installing a track panel;

wherein the method further comprises at least one of the following steps:

carrying out the installation of the track panel, the installation of the road bed and the installation of the subgrade or of part of the subgrade in a single operation by means of a railroad work vehicle; and
carrying out the removal of the existing track panel, the removal of the existing road bed and the removal of the existing subgrade or part of the subgrade in a single operation by means of a railroad work vehicle;
and wherein the method further comprises at least one of the following steps:

transporting material for the road bed to be installed, and, simultaneously, material for the subgrade or part of the subgrade to be installed, inward in a rail-bound manner in the operation of installing the subgrade or part of the subgrade, installing the track panel and installing the road bed; and transporting material of the removed road bed, and, simultaneously, material of the removed subgrade or part of the subgrade away in a rail-bound manner in the operation of removing the existing track panel, removing the existing road bed and removing the existing subgrade or part of the subgrade.

2. The method in accordance with claim 1, wherein the rail-bound transporting inward of material for the road bed to be installed, of material for the track panel to be installed and of material for the subgrade or part of the subgrade to be installed takes place simultaneously; or wherein the rail-bound transporting away of material of the removed track panel, of material of the removed road bed and of material of the removed subgrade or part of the subgrade takes place simultaneously.

3. The method in accordance with claim 1, wherein the rail-bound transporting inward of material for the road bed to be installed and of material for the subgrade or part of the subgrade to be installed or the rail-bound transporting away of material of the removed road bed and of material of the removed subgrade or part of the subgrade takes place without intermediate storage;

wherein the rail-bound transporting inward or transporting away of material is carried out on at least one conveyor track of a railroad vehicle on which transport bodies for articles or articles forming transport bodies in the form of piece goods can be traveled along the railroad vehicle.

4. The method in accordance with claim 1, wherein at least one protective layer for the subgrade is installed in the operation of installing the subgrade or part of the subgrade, installing the track panel and installing the road bed.

5. The method in accordance with claim 4, wherein a surface of the installed protective layer or of the plurality of installed protective layers is sealed; or wherein the installed at least one protective layer or the plurality of installed protective layers are reinforced; or wherein the installed protective layer or the plurality of installed protective layers are reinforced using a metal mat which is produced from wires during the new production or renovation of the rail track.

6. The method in accordance with claim 5, wherein the installed protective layer or the plurality of installed protective layers are reinforced using an expanded metal sheet which is produced by drawing out a coil during the new production or the renovation of the rail track; or wherein at least one protective layer to be installed is installed in a plurality of part layers.

7. The method in accordance with claim 4, wherein the at least one installed protective layer or part layer of a protective layer is roughened prior to the application of a subsequent protective layer or part layer of the same protective layer; or wherein the number and the thickness of the installed protective layers is varied in dependence on a property of the ground during the installation of the subgrade or part of the subgrade.

8. The method in accordance with claim 1, wherein the installation of the subgrade or part of the subgrade of the track panel and of the road bed is carried out by means of a railroad work vehicle, with at least one web of a geomaterial taken along on the railroad work vehicle being installed into the subgrade or into part of the subgrade.

9. The method in accordance with claim 8, wherein the at least one web of geomaterial is taken along in a rolled up and/or folded state on the railroad work vehicle and is removed automatically for the installation; or the at least one web of geomaterial is taken along on the railroad work vehicle as a roll wound around a coil axle, wherein the coil axle extends in parallel with the direction of work of the railroad work vehicle and the web is automatically unrolled and rotated for the installation; or wherein a plurality of webs of geomaterial are laid next to one another by means of an automatic laying apparatus of the railroad work vehicle.

10. The method in accordance with claim 1, wherein the road bed of an adjacent rail track is supported during the removal of the existing subgrade or part of the subgrade; or wherein a material is used for installing the subgrade or part of the subgrade which was removed in the operation of removing the existing subgrade or part of the subgrade; or wherein the ground is treated after the removal of the existing subgrade or part of the subgrade and prior to the installation of the subgrade or part of the subgrade by applying a stabilization means.

11. The method in accordance with claim 1, wherein the rails for the track panel to be installed are transported inward in a rail-bound manner; or wherein the rails of the removed track panel are transported away in a rail-bound manner; or wherein the rails of the removed track panel are cut prior to the transporting away.

12. The method in accordance with claim 11, wherein the rails for the track panel to be installed are transported inward in a rail-bound manner together with material for the road bed to be installed or for the subgrade or part of the subgrade to be installed; or wherein the rails of the removed track panel are transported away in a rail-bound manner together with material of the removed road bed or of the removed subgrade or part of the subgrade; or wherein the transporting inward or away of the rails takes place without infringing a clearance of a train traveling in an adjacent rail track.

13. The method in accordance with claim 1, wherein the ground is compacted after the removal of the previous subgrade or part of the subgrade and prior to the installation of the subgrade or part of the subgrade; or wherein the moisture of the ground to be compacted is measured and water is introduced as required into material provided for the subgrade or part of the subgrade to be installed in dependence on the measured moisture prior to the compacting; or wherein a measured variable, of a compactor element is detected on the compacting and at least one compacting parameter is adapted in dependence on the detected measured variable.

14. The method in accordance with claim 1, wherein new ballast, used ballast or recycled ballast is used in the installation of the road bed in dependence on a local load situation; or wherein the installed ballast is compacted in the operation of installing the road bed; or the installed road bed is profiled; or the position of the installed track panel is detected and documented in the operation of installing the track panel; or wherein the ironware of the installed track panel can be closed, in the operation of installing the track panel; or wherein a railroad work vehicle is used for the carrying out of the method.

15. A method for renovation of a rail track of claim 1, further comprising the step of conveying rails for a track panel to be installed or rails of a removed track panel through a railroad vehicle on a rail conveyor track arranged in or at the railroad vehicle.

16. The method in accordance with claim 15, wherein the rail conveyor track which is provided at a side of the railroad vehicle.

17. The method in accordance with claim 15, wherein the rails of the removed track panel are taken up from the ground and are transferred to the rail conveyor track; or wherein the rails for the track panel to be installed are transported inward on the rail conveyor track and are transferred for placing down into a region to the side of the railroad vehicle or beneath the railroad vehicle; and wherein the rails are drawn down by means of a tensile force transfer device onto the rail conveyor track of the railroad vehicle or down therefrom.

18. The method in accordance with claim 15, wherein the rails are cut to length for the rail-bound transporting inward and/or for the rail-bound transporting away and are brought into a transport container; or wherein the conveying of the rails takes place automatically; or wherein the rails for the track panel to be installed or the rails of the removed track panel are temporarily placed on the ground.

19. The method in accordance with claim 9, wherein new ballast, used ballast or recycled ballast is used in the installation of the road bed in dependence on a local load situation; and wherein the installed ballast is compacted in the operation of installing the road bed; and wherein the installed road bed is profiled; and wherein the position of the installed track panel is detected and documented in the operation of installing the track panel; and wherein the ironware of the installed track panel can be closed in the operation of installing the track panel; and wherein a railroad work vehicle is used for the carrying out of the method.

20. The method in accordance with claim 4, wherein the at least one protective layer for the subgrade comprises a plurality of protective layers for the subgrade, and wherein a separation layer is installed at least between two of the plurality of protective layers.

* * * * *